US008083232B2

(12) United States Patent
deJong et al.

(10) Patent No.: US 8,083,232 B2
(45) Date of Patent: Dec. 27, 2011

(54) SUBSTRATE MEDIA TRANSPORT SYSTEM WITH SPACED NIP

(75) Inventors: Joannes N. M. deJong, Hopewell Junction, NY (US); Lloyd A. Williams, Mahopac, NY (US); Matthew Dondiego, West Milford, NJ (US)

(73) Assignee: Xerox Corporation, Norwalk, CT (US)

( * ) Notice: Subject to any disclaimer, the term of this patent is extended or adjusted under 35 U.S.C. 154(b) by 169 days.

(21) Appl. No.: 12/547,179

(22) Filed: Aug. 25, 2009

(65) Prior Publication Data

US 2011/0049801 A1 Mar. 3, 2011

(51) Int. Cl.
*B65H 5/02* (2006.01)

(52) U.S. Cl. ..... 271/273; 271/274

(58) Field of Classification Search ..... 271/273, 271/274

See application file for complete search history.

(56) References Cited

U.S. PATENT DOCUMENTS

| | | | | |
|---|---|---|---|---|
| 7,252,287 | B2 * | 8/2007 | Tsutoh | 271/274 |
| 7,523,933 | B2 * | 4/2009 | Linder et al. | 271/274 |
| 2010/0191368 | A1 * | 7/2010 | Celeste et al. | 700/230 |

* cited by examiner

*Primary Examiner* — David H Bollinger
(74) *Attorney, Agent, or Firm* — Hoffmann & Baron, LLP

(57) ABSTRACT

An apparatus and method for transporting substrate of media including a nip assembly having a drive wheel operably connected to a drive mechanism for rotating the drive wheel and an idler wheel disposed adjacent the drive wheel. The drive wheel and idler wheel forming a nip therebetween. The drive wheel and idler wheel being displaced from each other forming a nip gap, wherein the nip gap is present absent the presence of the substrate media in the nip.

19 Claims, 4 Drawing Sheets

SUBSTRATE MEDIA TRANSPORT SYSTEM WITH SPACED NIP

TECHNICAL FIELD

The present disclosure generally relates to document processing devices and methods for operating such devices. More specifically, the present disclosure relates to a substrate media transport system with spaced nip to mitigate nip entrance disturbances that affect registration of a substrate media.

BACKGROUND

In document processing devices, accurate and reliable registration of the substrate media as it is transferred in a process direction is desirable. Even a slight skew or misalignment of the substrate media through an image transfer zone can lead to image and/or color registration errors. Such registration errors can occur as the substrate media passes through the nips.

Document processing devices typically include one or more sets of nip assemblies used to transport substrate media, such as sheets of paper, through the device. A nip assembly provides a force to the sheet as it passes through the nip assembly to propel it through the document processing device. A nip assembly typically includes a drive wheel and an idler wheel in rolling contact with the drive wheel to form the nip therebetween. One or more sets of drive wheels and idler wheels may be longitudinally aligned in order to form a nip. The driving wheel and the idler wheel may be urged together by a biasing device which in turn creates the nip force. The nip force is required such that the wheels properly engage the sheet as it passes through the nip. This nip force must be significant enough in order to eliminate slipping between the drive wheel and the sheet.

When a sheet being transported through the document processing device first engages the nip, the drive wheel and idler wheel are in rolling engagement with each other. As the sheet engages the wheels, at least one of the idler and drive wheels typically moves against the nip force in order to permit the sheet to enter the nip. The entering of the sheet into the nip results in nip disturbances which negatively affect sheet registration. When a sheet enters a nip, the sheet must perform work in displacing the wheel an amount equal to its thickness multiplied by the nip force. This work needs to be performed in the time it takes the sheet to fully enter the nip. The work required to move the wheel originates from a decrease in kinetic energy, i.e., speed, of the rotating nip assembly components. The controls used to regulate the nip velocity typically cannot effectively mitigate the nip disturbances. Registration of the sheets, therefore, is compromised.

Accordingly it would be desirable to provide a substrate media transport system having nips that reduce the disturbance caused by substrate media nips.

SUMMARY

Before the present systems, devices and methods are described, it is to be understood that this disclosure is not limited to the particular systems, devices and methods described, as these may vary. It is also to be understood that the terminology used in the description is for the purposes of describing the particular versions or embodiments only, and is not intended to limit the scope.

According to aspects described herein, there is disclosed an apparatus for transporting substrate media including a nip assembly having a drive wheel operably connected to a drive mechanism for rotating the drive wheel and an idler wheel disposed adjacent the drive wheel. The drive wheel and idler wheel forming a nip therebetween. The drive wheel and idler wheel being displaced from each other forming a nip gap, wherein the nip gap is present absent the presence of the substrate media in the nip.

According to further aspects described herein, there is disclosed an apparatus for mitigating nip entry disturbances including a nip assembly for transporting substrate media having a thickness therethrough. The nip assembly includes a drive wheel operably connected to a drive mechanism for rotating the drive wheel and including an idler wheel disposed adjacent the drive wheel. The drive wheel and idler wheel defining a nip therebetween. The drive wheel and idler wheel being displaced from each other forming a nip gap. The nip gap increasing in size upon entry of substrate media into the nip. A nip gap adjuster is operably connected to the nip assembly. The nip gap adjuster causing relative movement between the idler wheel and the drive wheel to adjust the size of the nip gap in response to the thickness of the substrate of media.

According to still further aspects described herein, there is disclosed a method of mitigating nip entrance disturbances including:

positioning an idler wheel adjacent to a drive wheel forming a nip, the drive wheel and idler wheel cooperating to transport substrate media through the nip; and forming a space between the idler wheel and the drive wheel to form a nip gap in the absence of substrate of media.

DETAILED DESCRIPTION

The following terms shall have, for the purposes of this application, the respective meanings set forth below.

A "document processing device" refers to a device that performs an operation in the course of producing, replicating, or transforming a document from one format to another format, such as from an electronic format to a physical format or vice versa. Document processing devices may include, without limitation, printers (using any printing technology, such as xerography, ink-jet, or offset); document scanners or specialized readers such as check readers; mail handling machines; fabric or wallpaper printers; or any device in which an image of any kind is created on and/or read from a moving substrate.

A "substrate of media" refers to, for example, paper, transparencies, parchment, film, fabric, plastic, or other substrates on which information can be reproduced, preferably in the form of a sheet or web.

A "nip" refers to a location in a document processing device at which a sheet is propelled in a process direction. A nip may be formed between an idler wheel and a drive wheel.

A "nip assembly" refers to components, for example and without limitation, a drive wheel and an idler wheel which form a nip.

A "drive wheel" refers to a nip assembly component that is designed to propel a sheet in contact with the nip. A drive wheel may comprise a compliant material, such as rubber, neoprene or the like. A drive wheel may be directly driven via a stepper motor, a DC motor or the like. Alternately, a drive wheel may be driven using a gear train, belt transmission or the like.

An "idler wheel" refers to a nip assembly component that is designed to provide a normal force against a sheet in order to enable the sheet to be propelled by the drive wheel. An idler wheel may comprise a non-compliant material, such as plastic.

A "nip gap" refers to a space disposed between the drive wheel and idler wheel of the nip assembly.

A "nip gap adjuster" refers to a device in communication with a nip for changing the size of the nip gap.

Figure 1:
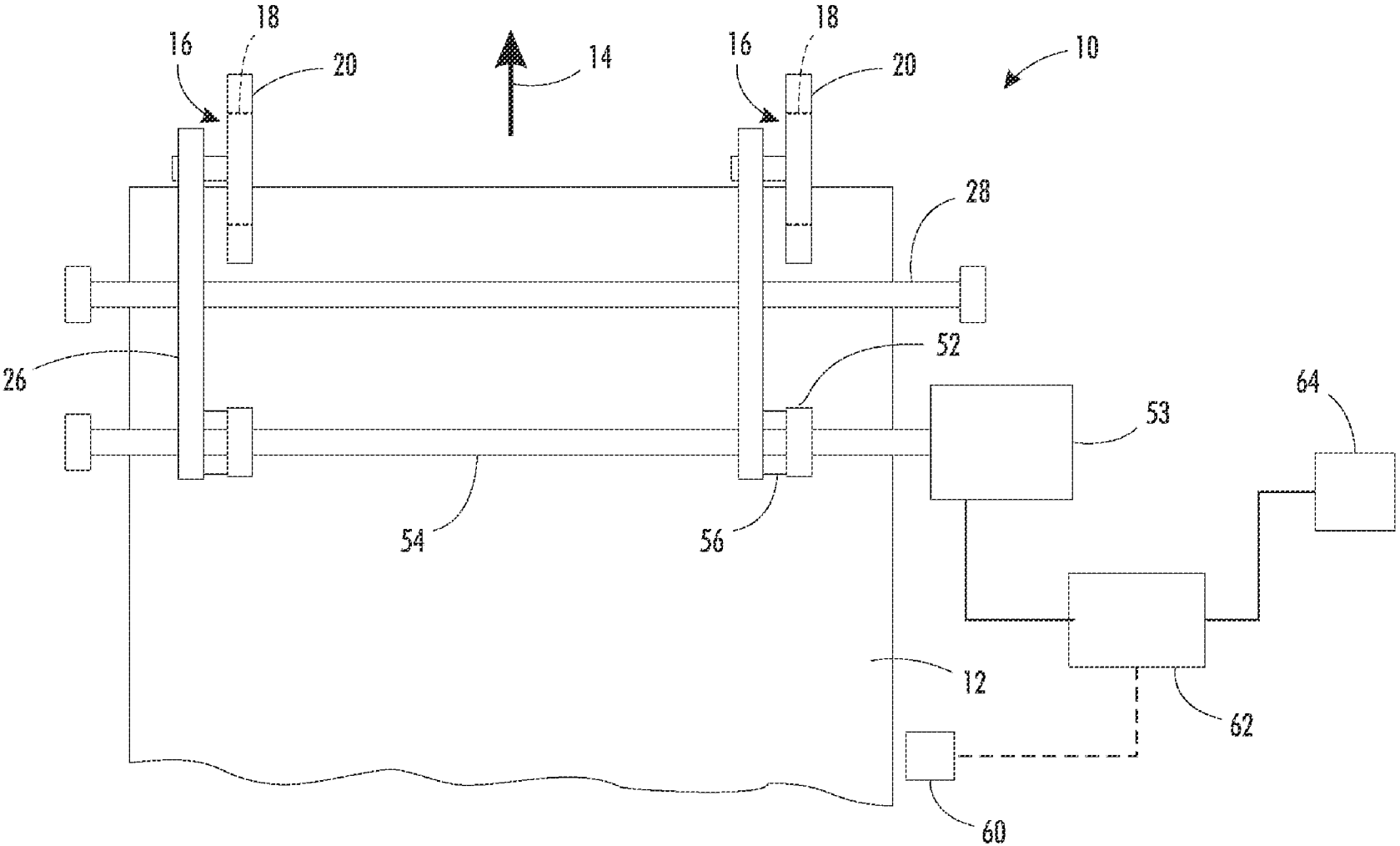
FIG. 1 is a top perspective schematic view of a sheet transport system according to an embodiment.
Figure 2:
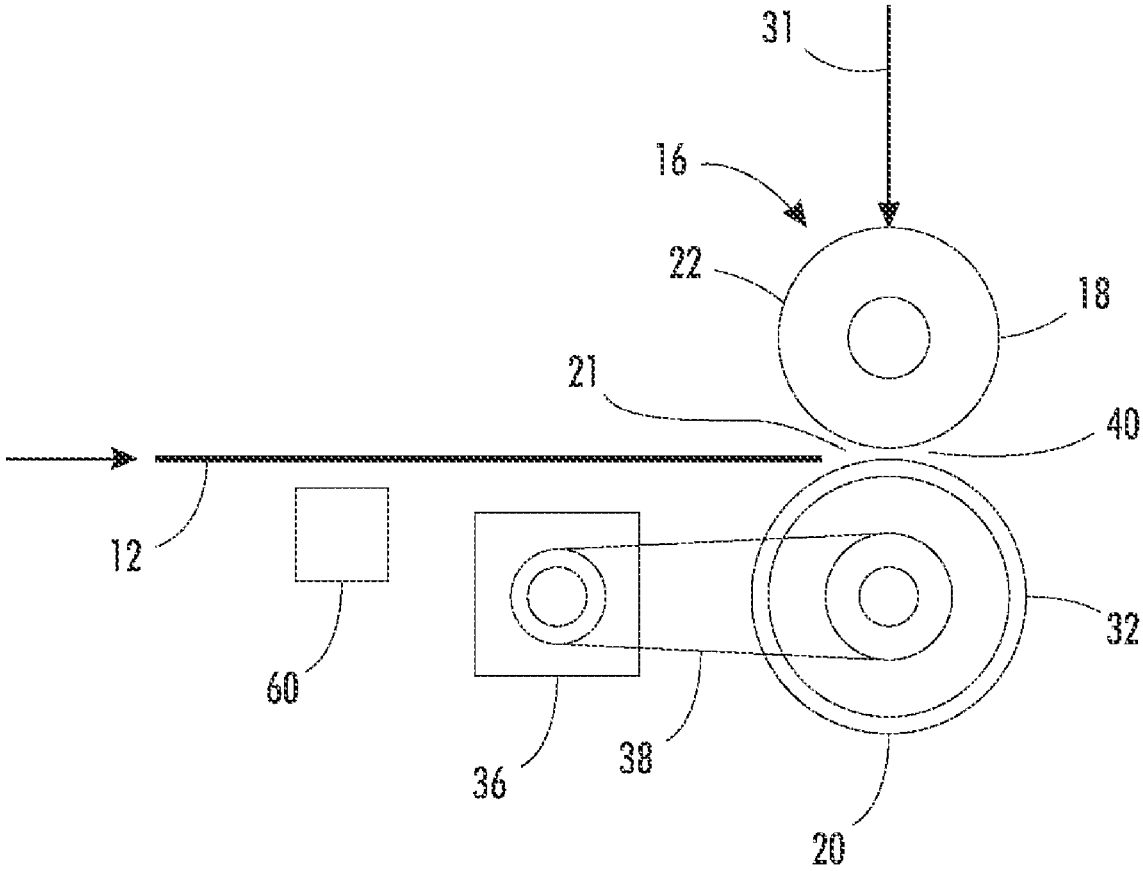
FIG. 2 is a side elevational schematic view of the sheet transport system of FIG. 1.
Figure 3:
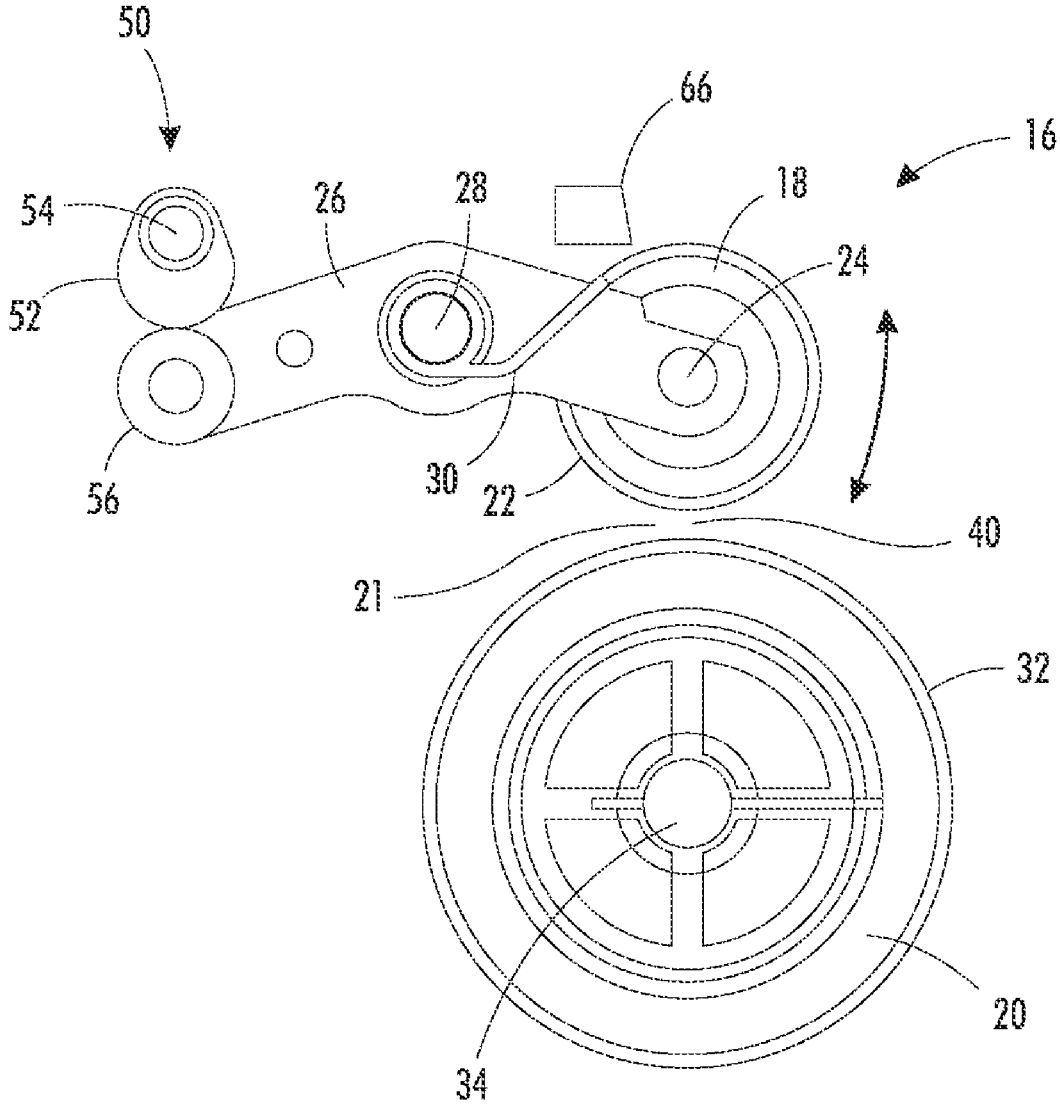
FIG. 3 is a side elevational view of a sheet transport system of FIG. 1 depicting an adjustable nip gap.

With reference to FIGS. 1-3, a substrate media transport system 10 conveys substrate of media such as sheet of media 12 along a processing path 14. The substrate media transport system may include one or more nip assemblies 16 longitudinally aligned transverse to the process direction 14. Each nip assembly 16 may include an idler wheel 18 and a drive wheel 20 which form a nip 21 therebetween. The idler wheel 18 provides a normal force against a sheet 12 that is being transported by the substrate media transport system 10 in order to enable the sheet to be propelled by the rotating drive wheel 20. The idler wheel 18 may have an outer surface 22 including a noncompliant material, such as hard plastic. The idler wheel 18 may rotate around a shaft 24. The idler wheel may be rotatably secured to one end of a pivot arm 26. Pivot arm 26 is pivotably secured to a pivot shaft 28 such that the idler wheel may pivot toward and away from the drive wheel 20. The pivot arm 26 may be attached to a biasing device 30, such as a torsion spring. The biasing device 30 tends to urge the idler wheel 18 toward the drive wheel 20 and provides the normal force, represented by arrow 31 in FIG. 2, for the idler wheel 18. Other methods of applying a normal force for the idler wheel 18 may be used and are within the scope of this disclosure.

The drive wheel 20 may include an outer surface 32 having a compliant material such as rubber, neoprene or the like. The compliant material helps to grip the sheet 12 and permit the drive wheel 20 to move the sheet through the nip 21. The drive wheel 20 rotates about a drive shaft 34 and may be directly driven by a drive motor 36, such as a stepper motor, a DC motor or the like. A transmission device 38 may extend between the drive motor 36 and the drive wheel 20 for imparting motion to the drive wheel 20. The transmission device 38 may include a timing belt, gear trains or other transmission means known to those of ordinary skill in the art. The drive wheels 20 of each of the nip assemblies 16 may move in a coordinated manner to propel the sheets 12 through the nips 21 in a controlled manner.

For each nip assembly 16, the idler wheels 18 and drive wheels 20 are separated by a nip gap 40. The nip gap size may be the sheet thickness minus a fixed value or a percentage of the sheet thickness. For example if a sheet is 20 milli-inches, the nip gap may be 16 milli-inches. The nip gap 40 is present even when there is no sheet within the nip 21. Upon receiving a sheet, the nip gap 40 may be sized such that it is less than the thickness of the sheet 12 being transported through the nips 21. Accordingly, when a sheet enters the nip 21, the drive wheel 20 will engage the sheet 12 and the sheet will separate the idler wheel from the drive wheel increasing the size of the nip gap 40. Movement of the idler wheel 18 acts against the force of the biasing device 30 resulting in a normal force being imparted by the idler wheel 18 as the sheet extends therethrough. This normal force helps to maintain the sheet in rolling contact with the drive wheel 20 to prevent slippage.

By selectively setting an initial nip gap 40 based on the sheet thickness, the sheet 12 entering the nips 21 does not have to lift the idler wheel the entire thickness of the sheet as would be the case if the idler wheel 18 were in rolling engagement with the drive wheel 20. Since the distance the sheet has to move the idler is substantially less, the amount of work required to lift the idler wheel 18 is also significantly less. By reducing the amount of work needed to be performed by the sheets, nip velocity disturbance is reduced and the sheets may maintain proper registration. In addition, reducing the work needed to be performed by the sheet decreases sheet damage and wear on the components.

When the nip assemblies 16 are intended to propel the sheets therethrough, the nip gap 40 may also be set such that it is smaller than the thickness of the sheet thereby the nip assemblies 16 still act upon the sheet, and the nip force is sufficient to propel the sheets through the nips 21. Typically, a nip force of 1 to 3 pounds may be used to propel a sheet through the nips, although other nip forces may be used. Accordingly, the nip gap 40 will be sized based on the sheet thickness. Alternatively, the nip gap 40 may be increased in size such that no nip force is applied to the sheets in which case the nip assembly 16 is in an open state. In the nip open state, a sheet may pass through the nip 21 without being influenced by the nip assembly 16.

The nip gap 40 may be adjustable in order to accommodate sheets having various thicknesses. Accordingly, the substrate media transport system 10 may include a gap adjustor 50. The gap adjustor 50 may operate to move the drive wheel and/or the idler wheel. For purposes of explanation, the gap adjustor 50 is shown operably connected to, and moves, the idler wheel 18 relative to the drive wheel 20. However, it is to be understood that it is within the contemplation of the present disclosure that the gap adjuster 50 may be operably connected to the drive wheel 20 to move the drive wheel 20 relative to the idler wheel 18. In one embodiment, the gap adjustor 50 may include a mechanical actuator such as a cam 52 secured to a cam shaft 54. The cam shaft 54 may be operably connected to a cam drive 53, such as a motor, a stepper motor or other device well known in the art, so that the position of the cam 52 may be adjusted. A cam follower 56 may be attached to the pivot arm 26 at the end opposite that of the idler wheel 18. The pivot arm 26 may be biased to move the idler wheel 18 toward the drive wheel 20, and the action of the cam drives the pivot arm 26 against the bias to move the idler wheel 18 away from the drive wheel. The cam 52 may be configured such that as the cam 52 is rotated the follower 56 moves, thereby moving the idler wheel 18 closer to or further from the drive wheel 20. This results in a change in the size of the nip gap 40. The cam 52 may be configured such that rotation of the cam in one direction moves the idler wheel 18 from the drive wheel 20, and when the cam is rotated in the opposite direction the idler wheel 18 moves closer to the drive wheel 20. It is to be understood that the idler wheel may be mounted to other mechanical actuators, such as electric, pneumatic, or electropneumatic actuators, which remove the idler wheel and adjust the nip gap.

The gap adjuster 50 may also be able to adjust the nip gap 40 such that it is larger than the thickness of the sheets being transported. In this case, the nip assembly 16 would be in the open state allowing sheets to freely pass therethrough.

Figure 4:
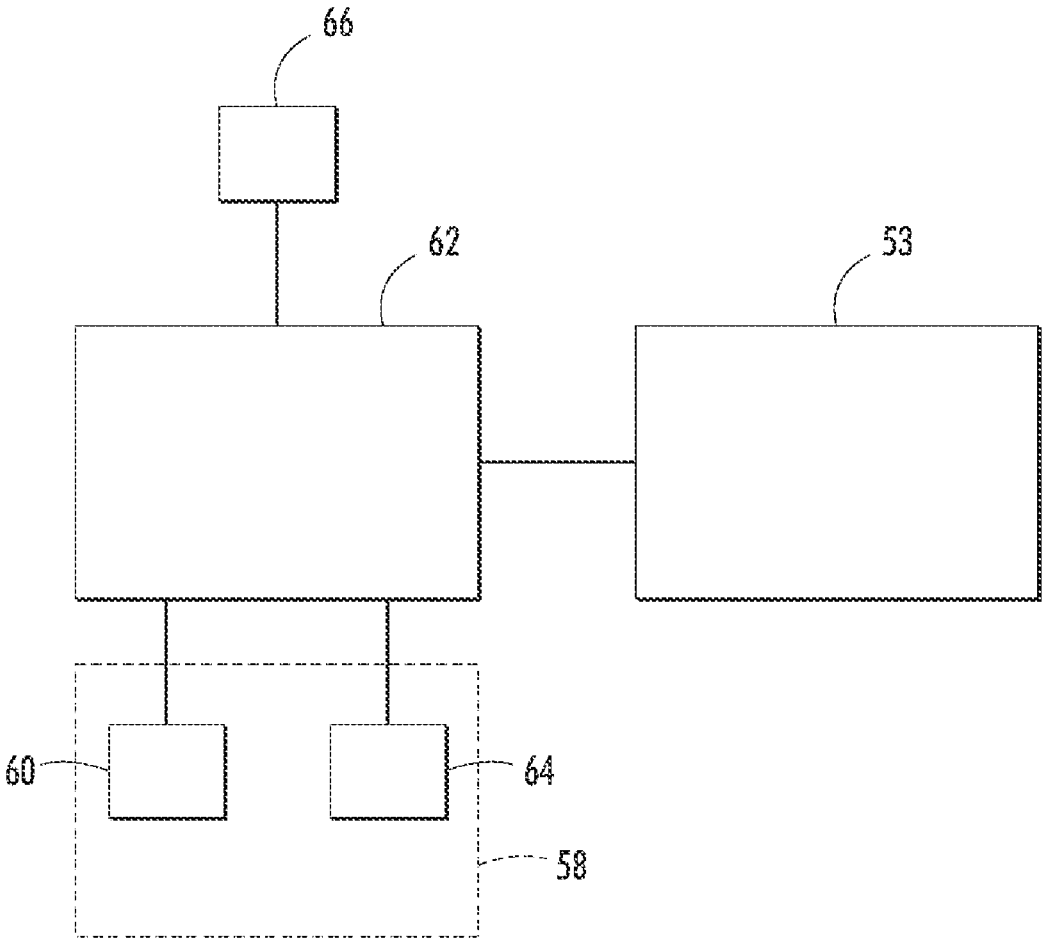
FIG. 4 is a schematic of a nip gap control system.

With reference to FIGS. 1 and 4, the nip gap 40 is adjustable and the size of the gap is a function of the thickness of the sheets of media passing through the nips 21. The nip gap is set such that the work performed by the sheets is reduced to mitigate nip disturbances, yet the nip assemblies still provide suffice nip force to propel the sheets through the nip assemblies without slippage. The nip gap 40 may be set in response to a signal generated by a thickness device 58. Device 58 may include one or more sensors 60 which determine the thickness of the sheets. Alternatively, the thickness device 58 may be an input device 64 on which an operator can enter the thickness of the media. Signals from either the sensors 60 and/or user input device 64 may be communicated to a controller 62. The controller may be in the form of a processor, micro processor, or the like. The controller 62 may be operably connected to the gap adjustor 50 and, in particular, the cam drive 53 to control the operation of the cam drive to adjust the size of the nip gap 40. A gap sensor 66 may be disposed adjacent to the nip assemblies 16 in order to sense the size of the nip gap 40. The gap sensor 66 may be in operative communication with the controller 62 in order to and provide feedback to the controller to permit precise control of the nip gap 40. Once the media thickness is determined and communicated to the controller 62, the controller may generate and send a signal to the gap adjustor 50 causing the nip gap 40 to be set to the appropriate size in response to the media thickness.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. An apparatus for transporting substrate of media comprising:

a nip assembly including a drive wheel operably connected to a drive mechanism for rotating the drive wheel and including an idler wheel disposed adjacent the drive wheel, the drive wheel and idler wheel forming a nip therebetween, the drive wheel and idler wheel being displaced from each other forming a nip gap, wherein the nip gap is present absent the presence of the substrate of media in the nip, and wherein at least one of the drive wheel and idler wheel is mounted to permit movement thereof upon the substrate of media entering the nip, and wherein the nip gap increases upon the substrate of media entering the nip.

2. The apparatus as defined in claim 1, wherein the nip gap has an initial maximum value less than a thickness of the substrate of media.

3. The apparatus as defined in claim 1, further including a nip gap adjustor operably connected to the nip assembly, and the nip gap is selectively adjustable in response to a thickness of the sheet.

4. The apparatus as defined in claim 3, wherein the idler wheel is rotatably secured to a pivot arm and the pivot arm is pivotally secured to a pivot shaft.

5. The apparatus as defined in claim 4, wherein the nip gap adjuster includes a cam and the pivot arm includes a cam follower engaging the cam, and wherein movement of the cam causes the idler wheel to move relative to the drive wheel, thereby adjusting the size of the nip gap.

6. The apparatus as defined in claim 3, further including a thickness device for obtaining the thickness of the substrate of media, and a controller in operative communication with the thickness device, the controller operating the nip gap adjustor to adjust the size of the nip gap responsive to the substrate media thickness.

7. An apparatus for mitigating nip entry disturbances comprising:

a nip assembly for transporting substrate of media having a thickness therethrough, the nip assembly including a drive wheel operably connected to a drive mechanism for rotating the drive wheel and including an idler wheel disposed adjacent the drive wheel, the drive wheel and idler wheel defining a nip therebetween and being displaced from each other forming a nip gap, the nip gap increasing in size upon entry of the substrate of media into the nip; and a nip gap adjuster operably connected to the nip assembly, the nip gap adjuster causing relative movement between the idler wheel and the drive wheel to adjust the size of the nip gap in response to the thickness of the substrate of media.

8. The apparatus as defined in claim 7, wherein the nip assembly exerts a nip force on the substrate of media sufficient to propel the sheet through the nip.

9. The apparatus as defined in claim 8, wherein the idler wheel is biased toward the drive wheel.

10. The apparatus as defined in claim 7, wherein the nip gap adjuster is operably connected to the idler wheel and moves the idler wheel relative to the drive wheel.

11. The apparatus as defined in claim 7, wherein the nip gap adjuster adjusts the nip gap size so that the nip gap is less than the thickness of the substrate of media.

12. The apparatus as defined in claim 7, wherein the nip gap adjuster includes a mechanical actuator operably connected to one of either the idler wheel or the drive wheel, wherein movement of the cam adjusts the size of the nip gap.

13. The apparatus as defined in claim 12, wherein the mechanical actuator includes cam which is operably connected to a cam drive and the cam drive is operably connected to a controller for controlling the operation of the cam drive.

14. The apparatus as defined in claim 13, wherein the controller is operably connected to a thickness device which obtains the thickness of the substrate of media, and the controller operates the cam drive to adjust the nip gap responsive to the thickness of the substrate of media.

15. A method of mitigating nip entrance disturbances comprising:

positioning an idler wheel adjacent to a drive wheel forming a nip therebetween, the drive wheel and idler wheel cooperating to transport substrate media through the nip;

forming a space between the idler wheel and the drive wheel to form a nip gap in the absence of substrate of media; and obtaining a thickness of the substrate media and adjusting the nip gap responsive to the media thickness.

16. The method as defined in claim 15, wherein the nip gap is sized such that the drive wheel and idler wheel exert a force on the sheet sufficient to propel the sheet through the nip.

17. The method as defined in claim 15, including moving the idler wheel relative to the drive wheel to form the nip gap.

18. An apparatus for transporting substrate of media comprising:

a nip assembly including a drive wheel operably connected to a drive mechanism for rotating the drive wheel and including an idler wheel disposed adjacent the drive wheel, the idler wheel being rotatably secured to a pivot arm and the pivot arm being pivotally secured to a pivot shaft, the drive wheel and idler wheel forming a nip there between, the drive wheel and idler wheel being displaced from each other forming a nip gap, wherein the nip gap is present absent the presence of the substrate of media in the nip; and a nip gap adjustor operably connected to the nip assembly for selectively adjusting the nip gap in response to a thickness of the sheet, and the nip gap adjuster including a cam and the pivot arm includes a cam follower engaging the cam, and wherein movement of the cam causes the idler wheel to move relative to the drive wheel, thereby adjusting the size of the nip gap.

19. An apparatus for transporting substrate of media comprising:

a nip assembly including a drive wheel operably connected to a drive mechanism for rotating the drive wheel and including an idler wheel disposed adjacent the drive wheel, the idler wheel being rotatably secured to a pivot arm and the pivot arm being pivotally secured to a pivot shaft, the drive wheel and idler wheel forming a nip there between, the drive wheel and idler wheel being displaced from each other forming a nip gap, wherein the nip gap is present absent the presence of the substrate of media in the nip;

a nip gap adjustor operably connected to the nip assembly for selectively adjusting the nip gap in response to a thickness of the sheet; and a thickness device for obtaining the thickness of the substrate of media, and a controller in operative communication with the thickness device, the controller operating the nip gap adjustor to adjust the size of the nip gap responsive to the substrate media thickness.

* * * * *